US008915038B1

(12) United States Patent
Whitcomb, Sr. et al.

(10) Patent No.: US 8,915,038 B1
(45) Date of Patent: Dec. 23, 2014

(54) DYNAMIC CONCRETE FORM

(71) Applicants: Lex A. Whitcomb, Sr., Franklin, IN (US); John D. Crane, Bloomington, IN (US); Kerry L. Kinser, Solsberry, IN (US)

(72) Inventors: Lex A. Whitcomb, Sr., Franklin, IN (US); John D. Crane, Bloomington, IN (US); Kerry L. Kinser, Solsberry, IN (US)

(73) Assignee: John D. Crane, Bloomington, IN (US)

( * ) Notice: Subject to any disclaimer, the term of this patent is extended or adjusted under 35 U.S.C. 154(b) by 0 days.

(21) Appl. No.: 13/948,392

(22) Filed: Jul. 23, 2013

Related U.S. Application Data

(60) Provisional application No. 61/828,862, filed on May 30, 2013.

(51) Int. Cl.
*E04C 3/30* (2006.01)
*E04G 15/06* (2006.01)

(52) U.S. Cl.
CPC ..... *E04G 15/063* (2013.01); *E28B 7/22* (2013.01)
USPC ..... 52/576; 52/220.8; 249/152; 249/177

(58) Field of Classification Search
USPC ..... 52/220.8, 576; 249/142, 177, 39, 152, 249/178, 43, 63, 64
See application file for complete search history.

(56) References Cited

U.S. PATENT DOCUMENTS

| | | | | |
|---|---|---|---|---|
| 3,265,349 | A | 8/1966 | Hamrick | |
| 3,523,552 | A * | 8/1970 | Ogden | 137/592 |
| 4,018,416 | A * | 4/1977 | Diener | 249/62 |
| 4,079,912 | A * | 3/1978 | Haydock | 249/184 |
| 4,998,705 | A | 3/1991 | Cass | |
| 5,156,755 | A | 10/1992 | Cass | |
| 5,245,806 | A | 9/1993 | Baur et al. | |
| 5,509,240 | A | 4/1996 | Barton, Jr. | |
| 6,149,121 | A | 11/2000 | Barton, Jr. | |
| 6,969,799 | B2 * | 11/2005 | Snyder | 174/483 |
| 7,581,362 | B2 | 9/2009 | Vaughan | |
| D623,731 | S * | 9/2010 | Snyder | D23/393 |
| 7,810,847 | B1 * | 10/2010 | Cornwall | 285/230 |
| 8,003,889 | B2 | 8/2011 | Turcovsky | |
| 8,122,680 | B2 | 2/2012 | Baur et al. | |
| 2011/0036038 | A1 * | 2/2011 | von Rummelhoff | 52/577 |
| 2012/0084972 | A1 | 4/2012 | Grady | |
| 2013/0020460 | A1 | 1/2013 | Von Rummelhoff | |

* cited by examiner

*Primary Examiner* — William Gilbert
*Assistant Examiner* — Gisele Ford
(74) *Attorney, Agent, or Firm* — Liell & McNeil

(57) ABSTRACT

A dynamic concrete form includes a sleeve defining a passage extending between first and second open ends. A first attachment feature extends outwardly in a first direction from the sleeve at the first open end and a second attachment feature extends outwardly in a second direction that is opposite the first direction at the second open end. In a first position, the passage has a first axial length, the first open end lies in a first plane, and the second open end lies in a second plane. In a second position, the passage has a second axial length that is greater than the first axial length, the first open end lies in the first plane or a first new plane that is parallel to the first plane, and the second open end lies in the second plane or a second new plane that is parallel to the second plane.

18 Claims, 3 Drawing Sheets

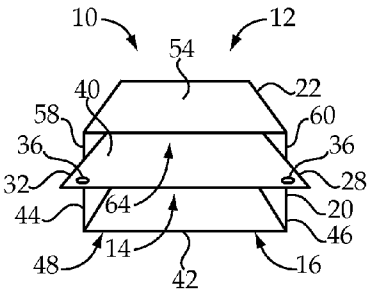
Fig.4
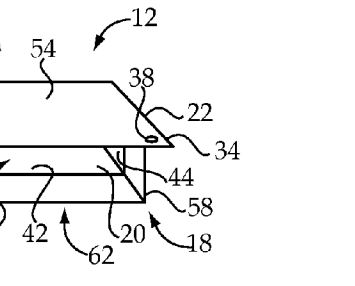
Fig.5
Fig.6
Fig.7
Fig.8
Fig.9

DYNAMIC CONCRETE FORM

RELATION TO OTHER PATENT APPLICATION

This application claims priority to provisional patent application 61/828,862, filed on May 30, 2013, with the same title.

TECHNICAL FIELD

The present disclosure relates generally to a dynamic concrete form, and more particularly to a dynamic concrete form for forming a void in a poured concrete structure.

BACKGROUND

Concrete structure forms are molds that are used to hold concrete in place while it hardens, ensuring that the concrete sets in a specific shape. For some typical construction projects, including the construction of buildings and parking garages, concrete structure forms are used to produce standard concrete shapes or pieces, including floors, walls, ceilings, stairs, and the like. The concrete structure forms are used to hold the concrete in place while it is poured and stabilize it as it sets. Once the concrete has set, the concrete structure forms can be removed so that the concrete has a chance to cure. After curing, additional structures can be built on or around the poured concrete and other construction related tasks can be performed.

It is common to provide voids, or passages, through concrete structures or pieces to accommodate the passage of utility wiring, including electrical wiring, and the like. To avoid the time, expense, and liability involved in drilling the voids or passages after the concrete has hardened, current methods of forming voids include positioning a tubular member between parallel concrete structure forms. This current method may be suitable in some instances. However, oftentimes, the tubular member becomes at least partially filled with concrete during pouring. In particular, the poured concrete may enter through opposing ends of the tubular member at the interfaces between the open ends and a respective one of the parallel concrete structure forms. As a result, the hardened concrete within the tubular member must be chiseled out to form an unobstructed void through the concrete structure. This additional step, occurring after the concrete pour, increases the time and expense for the project.

U.S. Pat. No. 8,003,889 to Turcovsky (hereinafter Turcovsky) discloses a conduit sleeve for use in concrete construction that provides a pass through within a concrete structure. The conduit sleeve includes a tubular member having a flange attached at one or both ends. A flexing structure is attached to one or both of the flange and the tubular member for allowing the flange to be angled relative to the tubular member when the flange is installed on a concrete form. The flexing structure allows the conduit to remain horizontal when there are variations in the angle of the form. Although the conduit sleeve of Turcovsky may provide improvements over some conventional methods of forming a concrete void, the Turcovsky conduit sleeve requires an inventory of tubular members of varying lengths and/or the customization of a tubular member at the job site. That is, the flanges are attached to a tubular member having an appropriate size for the particular use.

The present disclosure is directed to one or more of the problems or issues set forth above.

SUMMARY OF THE DISCLOSURE

In one aspect, a dynamic concrete form includes a sleeve defining a passage extending between first and second open ends of the sleeve. A first attachment feature extends outwardly in a first direction from the sleeve at the first open end and a second attachment feature extends outwardly in a second direction that is opposite the first direction from the sleeve at the second open end. Both of the first and second attachment features are parallel to a longitudinal axis of the sleeve. The dynamic concrete form includes a first position in which the passage has a first axial length, the first open end lies in a first plane, and the second open end lies in a second plane. The dynamic concrete form also includes a second position in which the passage has a second axial length that is greater than the first axial length, the first open end lies in the first plane or a first new plane that is parallel to the first plane, and the second open end lies in the second plane or a second new plane that is parallel to the second plane.

In another aspect, a poured concrete structure includes a first poured concrete piece including a top surface, a bottom surface, first and second opposing surfaces, and a void extending between the first and second opposing surfaces. A dynamic concrete form is supported within the first poured concrete piece to define the void. The dynamic concrete form includes a sleeve defining a passage, which corresponds to the void, extending between first and second open ends of the sleeve. The first open end lies in a first common plane with the first opposing surface, and the second open end lies in a second common plane with the second opposing surface. A first attachment feature extends outwardly in a first direction from the sleeve at the first open end and a second attachment feature extends outwardly in a second direction that is opposite the first direction from the sleeve at the second open end. A top of the sleeve defines a portion of the top surface of the first poured concrete piece.

In another aspect, a method of forming a void in a poured concrete structure using a dynamic concrete form is provided. The dynamic concrete form includes a sleeve defining a passage extending between first and second open ends of the sleeve. A first attachment flange extends outwardly in a first direction from the sleeve at the first open end, and a second attachment flange extends outwardly in a second direction that is opposite the first direction from the sleeve at the second open end. The method includes steps of attaching the first attachment flange to a first concrete structure form and seating the first open end against a first inner surface of the first concrete structure form, and attaching the second attachment flange to a second concrete structure form and seating the second open end against a second inner surface of the second concrete structure form. The method also includes pouring concrete in a space defined by the first concrete structure form and the second concrete structure form to form the poured concrete structure. The poured concrete contacts a bottom of the sleeve and spaced apart sidewalls of the sleeve. A distance between the first inner surface of the first concrete structure form and the second inner surface of the second concrete structure form is changed in response to the step of pouring concrete. An axial length of the passage is changed in response to the step of changing the distance between the first inner surface and the second inner surface by telescoping a first sleeve portion of the sleeve relative to a second sleeve portion of the sleeve. The method also includes forming the void in the poured concrete structure with the dynamic concrete form, wherein the passage corresponds to the void.

BRIEF DESCRIPTION OF THE DRAWINGS

FIG. 4 is a first end elevational view of the exemplary dynamic concrete form;

FIG. 5 is a second end elevational view of the exemplary dynamic concrete form;

FIG. 6 is a first side elevational view of the exemplary dynamic concrete form;

FIG. 7 is a second side elevational view of the exemplary dynamic concrete form;

FIG. 8 is a top plan view of the exemplary dynamic concrete form;

FIG. 9 is a bottom plan view of the exemplary dynamic concrete form;

DETAILED DESCRIPTION

Figure 1:
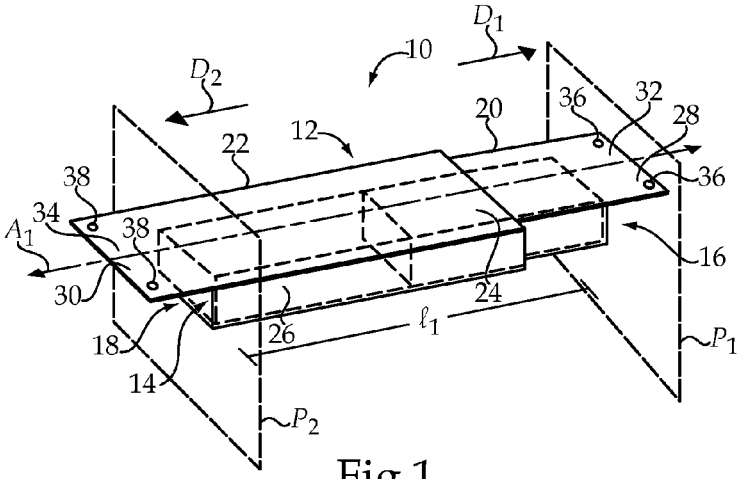
FIG. 1 is a perspective view of a dynamic concrete form, shown in a first position, according to one embodiment of the present disclosure.

FIG. 1 illustrates an exemplary dynamic concrete form 10, according to one embodiment of the present disclosure. As will be described in greater detail below, the dynamic concrete form 10 of the present disclosure may be positioned between concrete structure forms and used to form a void in a poured concrete structure. The exemplary dynamic concrete form 10 generally includes an open-ended sleeve 12, which may be made from common construction materials, including, for example, steel, concrete, and wood. In particular, the sleeve 12 defines a passage 14 (shown partially in phantom) extending between first and second open ends 16 and 18 of the sleeve 12. According to the exemplary embodiment, the sleeve 12 may include a first sleeve portion 20 telescopically received within a second sleeve portion 22. As such, the first sleeve portion 20 defines a first portion 24 of the passage 14 and the first open end 16, and the second sleeve portion 22 defines a second portion 26 of the passage 14 and the second open end 18. According to a position in which most or all the first sleeve portion 20 is telescopically received within the second sleeve portion 22, the first sleeve portion 20 may define a majority or all of the passage 14. Alternatively, if the first sleeve portion 20 is only slightly telescopically received within the second sleeve portion 22, a majority of both of the first and second sleeve portions 20 and 22 may define the passage 14.

As shown, the first open end 16 may lie in a first plane $P_1$ that is substantially perpendicular to a longitudinal axis $A_1$ of the sleeve 12. Similarly, the second open end 18 may lie in a second plane $P_2$ that is parallel with the first plane $P_1$ and substantially perpendicular to the longitudinal axis $A_1$. The first and second open ends 16 and 18 may bound opposing ends of the passage 14. That is, an axial length of the passage 14 may depend on how far the first sleeve portion 20 is telescopically received within the second sleeve portion 22, and how far apart the first and second open ends 16 and 18 are from one another. For example, according to a first position, shown in FIG. 1, the passage 14 may have a first axial length $l_1$ corresponding to a distance between the first and second open ends 16 and 18.

Figure 2:
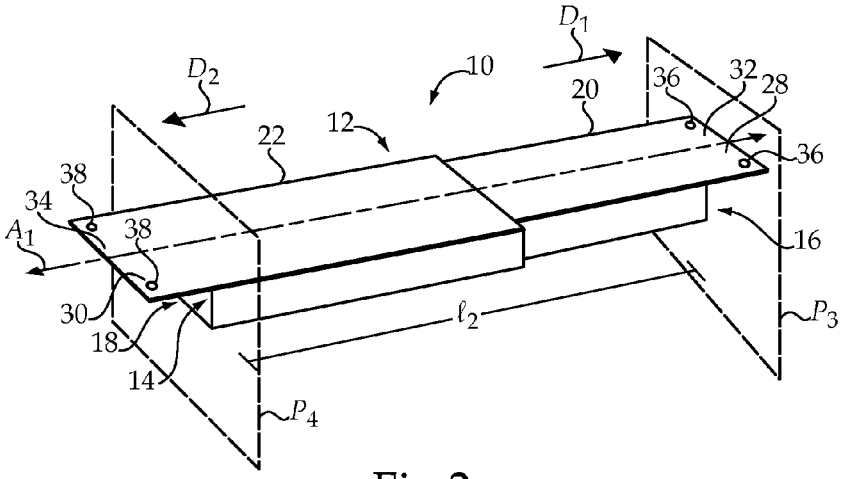
FIG. 2 is a perspective view of the dynamic concrete form of FIG. 1, shown in a second, or extended, position.

According to a second, or extended, position, shown in FIG. 2, the first sleeve portion 20 is withdrawn partially from within the second sleeve portion 22, relative to the first position, and the passage 14 has a second axial length $l_2$ that is greater than the first axial length $l_1$. Also according to the second position, the first open end 16 lies in the first plane $P_1$ or a first new plane $P_3$ that is parallel to the first plane $P_1$, and the second open end 18 lies in the second plane $P_2$ or a second new plane $P_4$ that is parallel to the second plane $P_2$. It should be appreciated that one or both of the first and second sleeve portions 20 and 22 may be moved away from or closer to the other of the sleeve portions 20 and 22 to change the length of the passage 14.

Referring to both FIGS. 1 and 2, the sleeve 12 also includes a first attachment feature 28 extending outwardly in a first direction $D_1$ from the sleeve 12 at the first open end 16 and a second attachment feature 30 extending outwardly in a second direction $D_2$ that is opposite the first direction $D_1$ from the sleeve 12 at the second open end 18. As shown, both of the first and second attachment features 28 and 30 are parallel to the longitudinal axis $A_1$ of the sleeve 12. According to the exemplary embodiment, the first attachment feature 28 may include a first flange 32 extending from the first open end 16, and the second attachment feature 30 may include a second flange 34 extending from the second open end 18. A number of first attachment openings 36 may be provided through the first flange 32, while a number of second attachment openings 38 may be provided through the second flange 34.

Figure 3:
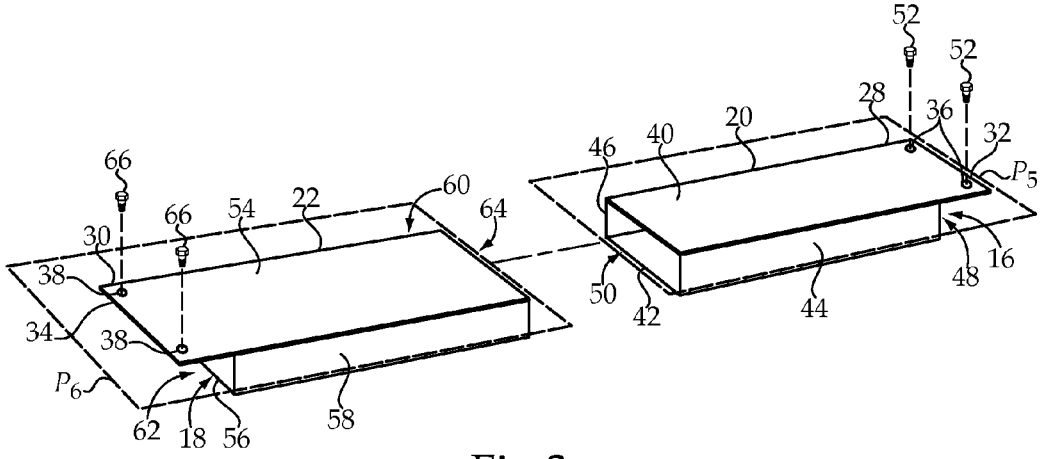
FIG. 3 is an exploded view of the dynamic concrete form of the previous FIGS.

Turning now to the exploded view of FIG. 3, each of the first sleeve portion 20 and the second sleeve portion 22 will be discussed in greater detail. The first sleeve portion 20 may have a generally rectangular cross section and may include a planar top 40, a planar bottom 42, and a pair of spaced apart planar sidewalls 44 and 46. The planar top 40 and planar bottom 42 may be parallel with one another, while the spaced apart planar sidewalls 44 and 46 are substantially parallel with one another and perpendicular to the planar top 40 and planar bottom 42. The first sleeve portion 20 also includes a first open end 48, which corresponds to the first open end 16 of the sleeve 12, and a second open end 50, which is configured for telescopic receipt within the second sleeve portion 22. The first flange 32 may extend from the planar top 40 of the first sleeve portion 20 at the first open end 48, with both the first flange 32 and the planar top 40 of the first sleeve portion 20 lying in a first common plane $P_5$. The first flange 32 may extend a predetermined distance from the first open end 16 suitable for supporting the first sleeve portion 20 with respect to a concrete structure form, as will be described below. To secure such a positioning, first fasteners 52 may be positioned through the first attachment openings 36 and a top edge of a concrete structure form or a structure supported by the concrete structure form.

The second sleeve portion 22 may be similar to the first sleeve portion 20, but may be slightly larger in size such that the first sleeve portion 20 may be telescopically received within the second sleeve portion 22. The second sleeve portion 22 may also have a generally rectangular cross section and may include a planar top 54, a planar bottom 56, and a pair of spaced apart planar sidewalls 58 and 60. The planar top 54 and bottom 56 of the second sleeve portion 22 may be parallel with one another, and the spaced apart planar sidewalls 58 and 60 may be substantially parallel with one another. The second sleeve portion 22 includes a first open end 62, which corresponds to the second open end 18 of the sleeve 12, and a second open end 64, which is configured for telescopic receipt of the first sleeve portion 20. The second flange 34 may extend from the planar top 54 of the second sleeve portion 22 at the first open end 62, with both the second flange 34 and the planar top 54 of the second sleeve portion 22 lying in a second common plane $P_6$. Due to the telescopic relationship of the first and second sleeve portions 20 and 22, the second common plane $P_6$ may be spaced above and parallel to the first common plane $P_5$. The second flange 34 may extend a predetermined distance from the first open end 62 suitable for supporting the second sleeve portion 22 either directly or indirectly with respect to a concrete structure form, and may be secured to the concrete structure form using second fasteners 66 positioned through the second attachment openings 38.

Alternative views are shown in FIGS. 4-9 to fully illustrate the exemplary embodiment. In particular, FIG. 4 illustrates a first end elevational view facing the first open end 16 of the dynamic concrete form 10. FIG. 5 illustrates a second end elevational view facing the second open end 18 of the dynamic concrete form 10. FIG. 6 depicts a first side elevational view facing sidewalls 44 and 58 of the first and second sleeve portions 20 and 22, respectively, while FIG. 7 depicts a second side elevational view facing sidewalls 46 and 60 of first and second sleeve portions 20 and 22. Top and bottom views are shown in FIGS. 8 and 9, respectively. That is, a top plan view facing planar top 40 of the first sleeve portion 20 and planar top 54 of the second sleeve portion 22 is shown in FIG. 8. A bottom plan view facing planar bottoms 42 and 56 of respective sleeve portions 20 and 22 is shown in FIG. 9.

INDUSTRIAL APPLICABILITY

Figure 10:
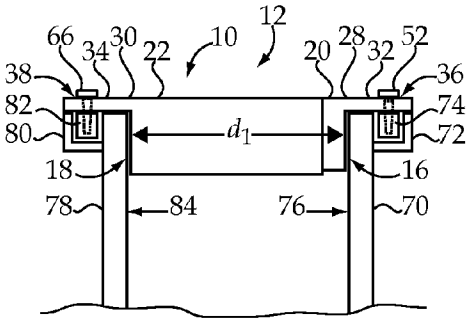
FIG. 10 is a side diagrammatic view of the dynamic concrete form of the previous FIGS. supported between first and second concrete structure forms, with the dynamic concrete form shown in the first position depicted in FIG. 1.

As mentioned above, the dynamic concrete form 10 of the present disclosure may be used to form a void in a poured concrete structure. In particular, and with reference to FIG. 10, the first attachment feature 28 or, more particularly, the first flange 32, of the first sleeve portion 20 may be attached to a first concrete structure form 70. The concrete structure form 70 may include a trough 72, or other similar structure, supporting a separate component or structure, such as, for example, a piece of lumber 74. The piece of lumber 74, which may, for example, include a 2x4, may be used to provide indirect attachment of the first sleeve portion 20 to the first concrete structure form 70. During this attachment, the first open end 16 of the sleeve 12 is seated against a first inner surface 76 of the first concrete structure form 70. Attachment may be accomplished by positioning first fasteners 52 through the first attachment openings 36 and the piece of lumber 74.

In a similar manner, the second attachment feature 30, or second flange 34, of the second sleeve portion 22 may be attached to a second concrete structure form 78. The first and second concrete structure forms 70 and 78 may be spaced apart and substantially parallel with one another, as shown. The second concrete structure form 78 may also include a trough 80 or other structure configured to support a separate component, such as a second piece of lumber 82. The trough 80 may be attached to or integral with the second concrete structure form 78. During attachment, the second open end 18 of the sleeve 12 may be seated against a second inner surface 84 of the second concrete structure form 78. Second fasteners 66 may be positioned through the second attachment openings 38 and the second piece of lumber 82 to facilitate attachment. Although indirect attachment of the dynamic concrete form 10 to the first and second concrete structure forms 70 and 78 is shown, direct attachment may alternatively be used. However, indirect attachments, such as those described, may be preferred, particularly where there is a desire to avoid modification of the concrete structure forms 70 and 78.

Figure 12:
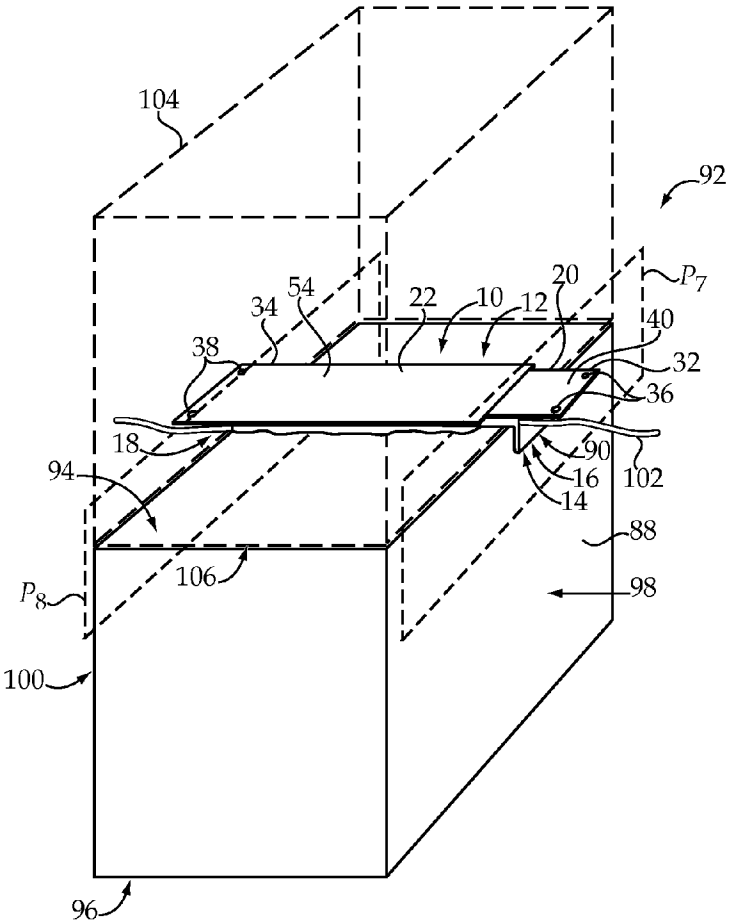
FIG. 12 is a poured concrete structure with the exemplary dynamic concrete form supported therein and defining a void through the poured concrete structure.
Figure 11:
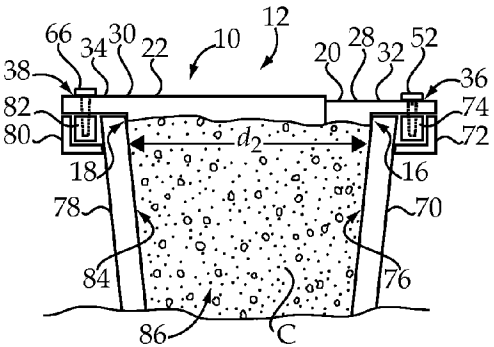
FIG. 11 is a side diagrammatic view of the dynamic concrete form of the previous FIGS. supported between the first and second concrete structure forms, with the dynamic concrete form shown in the second position depicted in FIG. 2.

Thereafter, concrete C, shown in FIG. 11, may be poured in a space 84 defined by the first concrete structure form 70 and the second concrete structure form 78 to form a poured concrete structure, which will be discussed with reference to FIG. 12. It should be appreciated that additional forms may be needed to define the space 84 but, for the sake of simplicity, only the first and second concrete structure forms 70 and 78 are shown. The poured concrete C may contact the planar bottoms 42 and 56 of the first and second sleeve portions 20 and 22 and the spaced apart sidewalls 44, 46 and 58, 60 of each of the first and second sleeve portions 20 and 22. During the concrete pour, a first distance $d_1$ (shown in FIG. 10) between the first inner surface 76 of the first concrete structure form 70 and the second inner surface 84 of the second concrete structure form 78 may be changed. For example, the first distance $d_1$ between the first and second concrete structure forms 70 and 78 may increase to a second distance $d_2$, particularly at the tops thereof.

The dynamic concrete form 10 of the present disclosure may be used to compensate for the movement of the first and second concrete structure forms 70 and 78, which may be caused by the weight and movement of the concrete C. In particular, as the first distance $d_1$ between the first and second concrete structure forms 70 and 78 increases to the second distance $d_2$ at the positioning of the dynamic concrete form 10, the axial length of the passage 14 defined by the sleeve 12 also changes by telescoping the first sleeve portion 20 with respect to the second sleeve portion 22. For example, the dynamic concrete form 10 may move from the first position, shown in FIG. 1, in which the passage 14 has a first axial length $l_1$ to the second position, shown in FIG. 2, in which the passage 14 has a second axial length $l_2$, during the concrete pour. Once the concrete C has set, and as shown in FIG. 12, the first and second concrete structure forms 70 and 78 may be removed to expose a first poured concrete structure 88 having a void 90 corresponding to the sleeve passage 14.

The first poured concrete piece 88 may be a portion of a poured concrete structure 92. For example, the first poured concrete piece 88 may represent a vertical wall of a building or parking garage. The first poured concrete piece 88 may include a top surface 94, a bottom surface 96, first and second opposing surfaces 98 and 100, and the void 90 extending between the first and second opposing surfaces 98 and 100. The dynamic concrete form 10 is supported within the first poured concrete piece 88 to define the void 90. In particular, the passage 14 through the sleeve 12 corresponds to or forms the void 90 through the first poured concrete piece 88. Utility wiring 102, or other similar components relevant to the specific construction project, may be received through the void 90 or, more particularly, the passage 14 of the sleeve 12.

As shown, the first open end 16 of the sleeve 12 may lie in a first common plane $P_7$ with the first opposing surface 98, and the second open end 18 may lie in a second common plane $P_8$ with the second opposing surface 100. The first and second flanges 32 and 34 extend outwardly beyond the first and second common planes $P_7$ and $P_8$, as shown. In addition, the planar tops 40 and 54 of the first and second sleeve portions 20 and 22 may define a portion of the top surface 94 of the first poured concrete piece 88. As is shown in phantom, a second poured concrete piece 104 may include a bottom surface 106 contacting the tops 40 and 54 of the first and second sleeve portions 20 and 22.

The dynamic concrete form 10 disclosed herein provides an improved means for creating voids in poured concrete. In particular, the dynamic concrete form 10 does not require modification of existing concrete structure forms, such as forms 70 and 78, but, rather, uses an indirect attachment to the forms 70 and 78, as described above. The dynamic concrete form 10 is telescopically adjustable in length to work with concrete structure forms spaced apart at various distances to provide resulting concrete structures of various widths. During the concrete pour, the dynamic concrete form 10 dynamically adjusts in length to compensate for movement, such as outward flexing, of the forms 70 and 78 resulting from the weight and movement of the poured concrete C. The seated positions of the open ends 16 and 18 relative to the concrete structure forms 70 and 78, as a result of the attachment of the dynamic concrete form 10 to the forms 70 and 78 described herein, block or reduce entry of the poured concrete C into the passage 14 of the sleeve 12. As such, after the concrete C has hardened and the concrete structure forms 70 and 78 have been removed, an unobstructed void 90 is provided.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A method of forming a void in a poured concrete structure using a dynamic concrete form, the dynamic concrete form including a sleeve defining a passage extending between first and second open ends of the sleeve, a first attachment flange extending outwardly in a first direction from, and being coplanar with a top of, the sleeve at the first open end, and a second attachment flange extending outwardly in a second direction that is opposite the first direction from, and being coplanar with a top of, the sleeve at the second open end, the method comprising steps of:

attaching the first attachment flange to a first concrete structure form and seating the first open end against a first inner surface of the first concrete structure form;

attaching the second attachment flange to a second concrete structure form and seating the second open end against a second inner surface of the second concrete structure form;

pouring concrete in a space defined by the first concrete structure form and the second concrete structure form to form the poured concrete structure, wherein the poured concrete contacts a bottom of the sleeve and spaced apart sidewalls of the sleeve;

changing a distance between the first inner surface of the first concrete structure form and the second inner surface of the second concrete structure form in response to the step of pouring concrete;

changing an axial length of the passage in response to the step of changing the distance between the first inner surface and the second inner surface by telescoping a first sleeve portion of the sleeve relative to a second sleeve portion of the sleeve; and forming the void in the poured concrete structure with the dynamic concrete form, wherein the passage corresponds to the void.

2. The method of claim 1, wherein the step of attaching the first attachment flange to the first concrete structure form includes attaching the first attachment flange to a separate component supported in a trough of the first concrete structure form.

3. The method of claim 2, further including positioning a first fastener through a first attachment opening through the first attachment flange and the separate component.

4. The method of claim 3, wherein the step of changing the distance between the first inner surface and the second inner surface includes increasing the distance between the first inner surface and the second inner surface, and the step of changing the axial length of the passage includes increasing the axial length of the passage.

5. The method of claim 3, wherein a first top of the first sleeve portion and a second top of the second sleeve portion define a portion of a top surface of the poured concreted structure.

6. A dynamic concrete form, comprising:

a sleeve defining a passage extending between first and second open ends of the sleeve;

a first attachment feature extending outwardly in a first direction from the sleeve at the first open end and a second attachment feature extending outwardly in a second direction that is opposite the first direction from the sleeve at the second open end, wherein both of the first and second attachment features include respective flanges that extend from and are coplanar with, a top of the sleeve and are oriented parallel to a longitudinal axis of the sleeve;

a first position in which the passage has a first axial length, the first open end lies in a first plane, and the second open end lies in a second plane; and a second position in which the passage has a second axial length that is greater than the first axial length, the first open end lies in the first plane or a first new plane that is parallel to the first plane, and the second open end lies in the second plane or a second new plane that is parallel to the second plane.

7. The dynamic concrete form of claim 6, wherein the sleeve includes a first sleeve portion telescopically received within a second sleeve portion, wherein the first sleeve portion defines a first portion of the passage and the first open end, and the second sleeve portion defines a second portion of the passage and the second open end.

8. The dynamic concrete form of claim 7, wherein each of the first and second sleeve portions includes a rectangular cross section.

9. The dynamic concrete form of claim 7, wherein each of the first and second sleeve portions includes a planar top, a planar bottom, and a pair of spaced apart planar sidewalls.

10. The dynamic concrete form of claim 9, wherein the respective flanges include a first flange extending from the planar top of the first sleeve portion, and a second flange extending from the planar top of the second sleeve portion.

11. The dynamic concrete form of claim 10, wherein the first flange and the planar top of the first sleeve portion lie in a first common plane, and the second flange and the planar top of the second sleeve portion lie in a second common plane that is spaced above and parallel to the first common plane.

12. The dynamic concrete form of claim 10, further including an attachment opening positioned through each of the first and second flanges and being oriented perpendicular to the longitudinal axis.

13. A dynamic concrete form comprising:

a first sleeve portion with a first attachment feature configured for attachment to exactly one of a first vertical concrete wall form and a second vertical concrete wall form;

a second sleeve portion telescopically slidable in the first sleeve portion to define a continuum of different sleeve lengths along a longitudinal axis, and the second sleeve portion has a second attachment feature configured for attachment to exactly the other one of the first vertical concrete wall form and the second vertical concrete wall form;

the first attachment feature and the second attachment feature being separated by a distance greater than the sleeve length at each of the continuum of different sleeve lengths, and both of the first and second attachment features include respective flanges that extend from, and are coplanar with, a top of the respective first and second sleeve portions; and wherein the sleeve length changes dynamically responsive to movement of the first vertical concrete wall form relative to the second concrete wall form during a concrete pour into a space between first vertical concrete wall form and the second concrete wall form.

14. The dynamic concrete form of claim 13 wherein each of the first attachment feature and the second attachment feature includes an attachment opening that are separated by a distance greater than the sleeve length at each of the continuum of different sleeve lengths.

15. The dynamic concrete form of claim 14 wherein the attachment openings are oriented perpendicular to the longitudinal axis.

16. The dynamic concrete form of claim 15 wherein each of the attachment openings extend through respective flanges that extend from a top of first sleeve portion and the second sleeve portion, respectively.

17. The dynamic concrete form of claim 16 wherein the flanges lie in respective planes that are parallel to each other.

18. The dynamic concrete form of claim 17 including a first piece of lumber attached to the first sleeve portion with a first fastener extending through a first attachment opening of the attachment openings; and a second piece of lumber attached to the second sleeve portion with a second fastener extending through a second attachment opening of the attachment openings.

* * * * *